United States Patent [19]

Peffer et al.

[11] 4,130,852

[45] Dec. 19, 1978

[54] GROUNDED GRID STATIC DISCHARGE APPARATUS

[75] Inventors: Robert M. Peffer, Penfield; Albert H. Rehn, Rochester; Zacharie Grose, Fairport, all of N.Y.

[73] Assignee: Eastman Kodak Company, Rochester, N.Y.

[21] Appl. No.: 820,171

[22] Filed: Jul. 29, 1977

[51] Int. Cl.[2] ..... H05F 3/04

[52] U.S. Cl. ..... 361/213; 250/325; 361/214

[58] Field of Search ..... 361/213, 214, 230; 250/324, 325, 326

[56] References Cited

U.S. PATENT DOCUMENTS

| | | | |
|---|---|---|---|
| 940,429 | 11/1909 | Chapman | 361/213 |
| 2,752,533 | 6/1956 | Maas | 361/213 |
| 3,790,854 | 2/1974 | Dryczynski et al. | 361/213 |
| 4,027,201 | 5/1977 | Bacon et al. | 361/213 |

FOREIGN PATENT DOCUMENTS

| | | | |
|---|---|---|---|
| 2404982 | 8/1974 | Fed. Rep. of Germany | 361/214 |

*Primary Examiner*—Gerald Goldberg
*Attorney, Agent, or Firm*—Lawrence P. Kessler

[57] ABSTRACT

Grounded grid static discharge apparatus having a pair of spaced insulator blocks mounted in a shell. A grounded grid is fixed to the shell located adjacent to a sheet travel path. The insulator blocks have openings which serve as radial locators for a high voltage corona wire, extending between the blocks. A contact member, housed within one of the blocks, captures one end of the corona wire and positions the corona wire in relation to the respective opening of the block. A high voltage electrical coupling is made to the corona wire by inserting a male connector from a high voltage source into direct engagement with the contact member to complete the coupling with a minimum of electrical interfaces. The other insulator block has an end cap for capturing the opposite end of the corona wire. The end cap is urged in a direction to provide tension in the corona wire to maintain the wire in the radial locators for proper spatial positioning of the wire with respect to the shell and grid.

11 Claims, 5 Drawing Figures

GROUNDED GRID STATIC DISCHARGE APPARATUS

BACKGROUND OF THE INVENTION

1. Field of the Invention

This invention relates generally to static charge eliminators, and more particularly to a grounded grid static discharge apparatus for dissipating static charge on moving sheets.

2. Description of the Prior Art

In order to improve the productivity of high speed copier/duplicators, apparatus has been described in Belgian Pat. No. 835,568 issued May 13, 1976, for recirculating discrete pages of an original multi-page document to enable the document to be copied in page sequential order. This apparatus, called a recirculating document feeder, removes discrete pages of the original document from a hopper, feeds the pages seriatim to the platen of an electrophotographic copier and, after exposure to an illumination source for obtaining an image of the document page, returns the page to the hopper. The transport of the pages about the recirculation path is accomplished by an oscillating vacuum feeder and by friction feed rollers.

As is well known, due to the phenomenon referred to as the triboelectric effect, when two members are moved relative to one another, friction contact between the surfaces of the members generates a static electric charge on the surfaces. Thus in a sheet transport apparatus, such as the recirculating feeder, as sheets (discrete document pages) slide across the glass platen (or any other support surface), or move relative to one another in the sheet stack, static electrical charges may build up on the sheets. When the sheets develop such a charge they tend to be attracted to (or repelled from) adjacent surfaces with which they come in contact rather than to slide readily over such surfaces. This reaction between the sheets and the opposed surfaces may interfere with the feeding of the sheets and can result in jams in the transport apparatus.

Many different means have been employed to eliminate the static electrical charge on moving sheets in a transport apparatus. One effective mechanism for removing the static charge includes an electrical conductor positioned adjacent to the sheet travel path, as described in U.S. Pat. No. 983,536 to Chapman, issued Feb. 7, 1911. The conductor is connected to a high voltage alternating current source which creates an electrical field of alternating polarity surrounding the conductor. A second conductor, which is grounded, is positioned between the high voltage conductor and the sheet travel path. The grounded conductor normally absorbs the ions of the electrical field of the high voltage conductor. However, when sheets having a static charge move into the vicinity of the grounded conductor, the grounded conductor permits passage to the sheets of a proportional number of ions of opposite polarity to the charge on the sheets. These oppositely charged ions effectively neutralize the charge on the sheet.

Some typical corona generators, albeit not for static elimination but rather for charging purposes, are shown in U.S. Pat. Nos. 3,457,405; 3,566,223; 3,908,127 and 3,936,635. As can be seen in these patents, the end supports for the corona wires to position and tension the wires are relatively complex in either the shape or number of the parts employed. Furthermore a multiplicity of elements are required to electrically couple the high voltage source to the corona wire.

SUMMARY OF THE INVENTION

In accordance with the present invention a static discharge apparatus is provided for a sheet transport mechanism, the static discharge apparatus being of simple construction and having a minimum number of high voltage electrical interfaces to the corona wire of the apparatus. The static discharge apparatus includes a pair of spaced insulator blocks mounted in a shell. A grounded grid is fixed to the shell adjacent to the sheet travel path. The grid may, be supported for example, within the sheet transport mechanism in contact with a grounded portion of a sheet travel path. The insulator blocks have aligned openings which serve as radial locators for the high voltage corona wire, extending between the blocks. A contact member, housed within one of the blocks, captures one end of the corona wire and positions the corona wire in relation to the respective opening of the block. A high voltage electrical coupling is made to the corona wire by inserting a male connector from a high voltage source into direct engagement with the contact member to complete the electrical coupling with a minimum of electrical interfaces. The other insulator block has an end cap for capturing the opposite end of the corona wire. The end cap is urged in a direction to provide tension in the corona wire to maintain the wire in the radial locators for proper spatial positioning of the wire with respect to the shell and grid.

The invention, and its objects and advantages, will become more apparent in the detailed description of the preferred embodiment presented below.

DESCRIPTION OF THE PREFERRED EMBODIMENT

Figure 1:
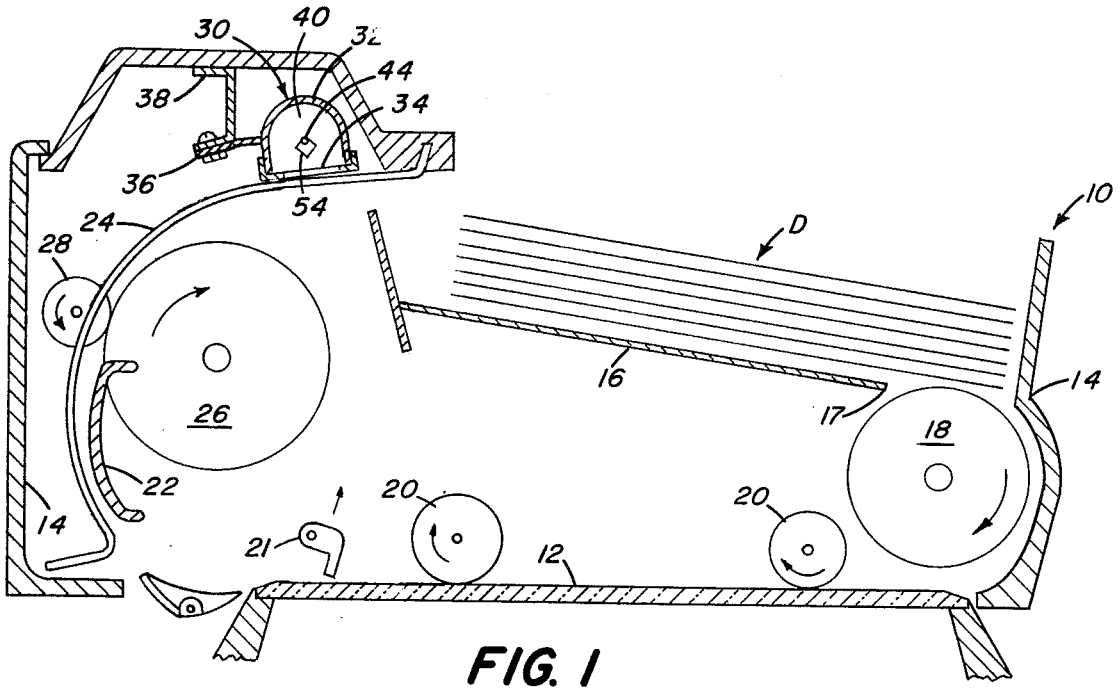
FIG. 1 is a generally schematic side elevational view, in section of a recirculating document feeder incorporating a static discharge apparatus according to this invention.

Referring now to the drawings, FIG. 1 shows, in somewhat simplified form, a recirculating document feeder 10 including a static discharge apparatus 30. While the static discharge apparatus of this invention may be used with any known sheet or web transport mechanism, it is particularly adapted for the recirculating document feeder fully described in Belgian Pat. No. 835,568. The feeder of that disclosure and its operation are described herein only to the extent necessary for a complete understanding of the instant invention.

The feeder 10, which is mounted to overlie a glass platen 12 of an electrophotographic copier (not shown), includes a frame 14 within which a document hopper 16 is mounted. When it is desired to copy a multi-page document D (having a plurality of discrete pages), the document D is placed in the hopper 16 in page sequential order, first page on top, image side up. The plurality of discrete pages of the document D are sheets of paper of any common bond or weight. Located adjacent to an opening 17 in the forward end of the hopper 16 is a feed mechanism 18 (such as an oscillating vacuum feeder) which, when the copy cycle is initiated, removes the last discrete page of the document and transports the page, image side down, to the platen 12. Rotating drive rollers 20 overlying the platen, frictionally engage the page to position the page on the platen against a pivoting registration gate 21. When the page is registered against the gate, it is exposed by an illumination system within the copier to obtain a latent electrostatic image of the particular page on a charged photoconductive member. The electrostatic image is then processed to obtain an electrophotographic copy of that page on a copy receiver sheet.

Once the requisite electrostatic image is formed, the registration gate 21 pivots out of the sheet path and rollers 20 frictionally drive the page from the platen into a return path formed by a guide plate 22 and a wireform guide 24 fixed to the frame 14. In the return path, a drive roller 26, cooperating with a nip roller 28, transports the page along the return path back into the hopper 16 where it is received on top of the other sheets (pages) of the document D. The described cycle is repeated for each succeeding page of the document D until the required number of complete copies of the document is produced.

The sliding action of a page relative to another page in the hopper 16, or between the page and the glass of the platen 12 (or any other contacted member), generates a static charge on the page due to the triboelectric effect phenomenon. The triboelectrically generated charge (and/or any other developed static charge) can build up to a level at which it causes the page to adhere to (or be repelled by) the other pages in the hopper, or to the platen glass or the guide plate 22 on subsequent recirculating passes of the page. Such reaction between the pages and/or the guide surfaces may inhibit proper transport of a page in its recirculating travel path.

Figure 2:
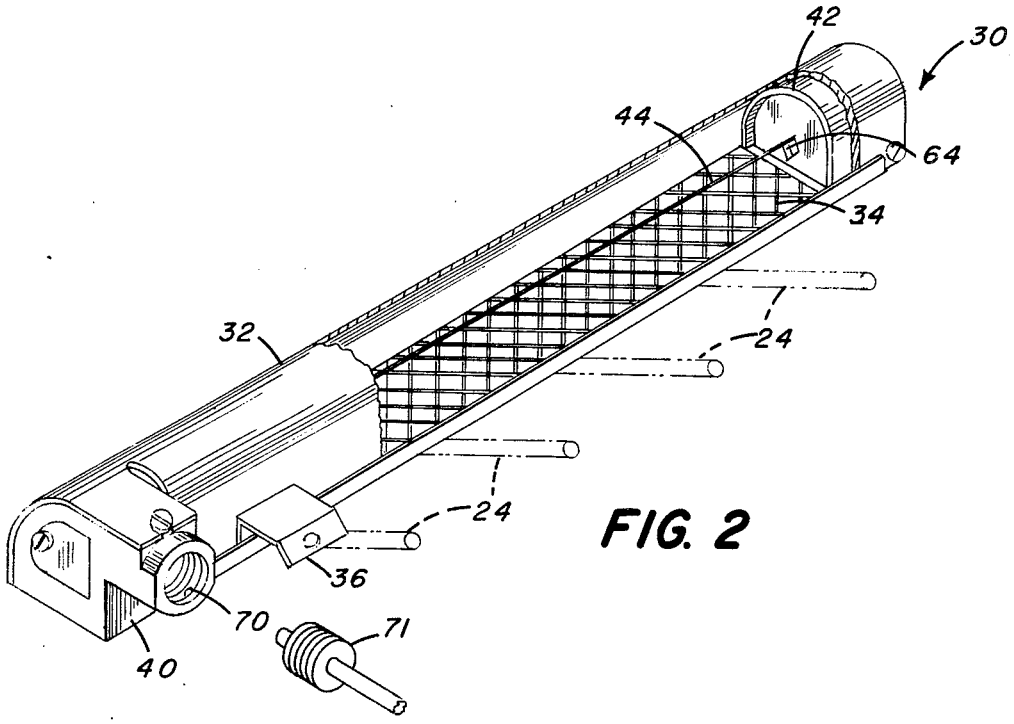
FIG. 2 is a perspective view, on an enlarged scale, of the static discharge apparatus of FIG. 1 with a portion broken away to facilitate viewing.

Accordingly, it has been found that by providing a static discharge apparatus 30 in the return path of the feeder 10, the static charge on the transported pages may be substantially eliminated to improve the handling of the discrete pages of the document D during their recirculation. Additionally, with the static charge removed, the proper stacking of sheets in the hopper 16 is assured. As shown in FIGS. 1 and 2, the static discharge apparatus 30 includes a generally U-shaped shell 32 extending transversely across the return path for the recirculating pages. The shell 32 may be formed of a conductive material. A grid 34 is fixed to the legs of the shell 32 to span the opening thereof. The grid, which has substantial open space is formed of conductive material such as a perforated plate, wire mesh, or expanded metal. A bracket 36 fixed to the shell 32 is mounted on bracket 38 extending from the frame 14 of the recirculating feeder 10 to position the grid 34 of the apparatus 30 on the wireform 24 adjacent to the exit from the return path.

Figure 3:
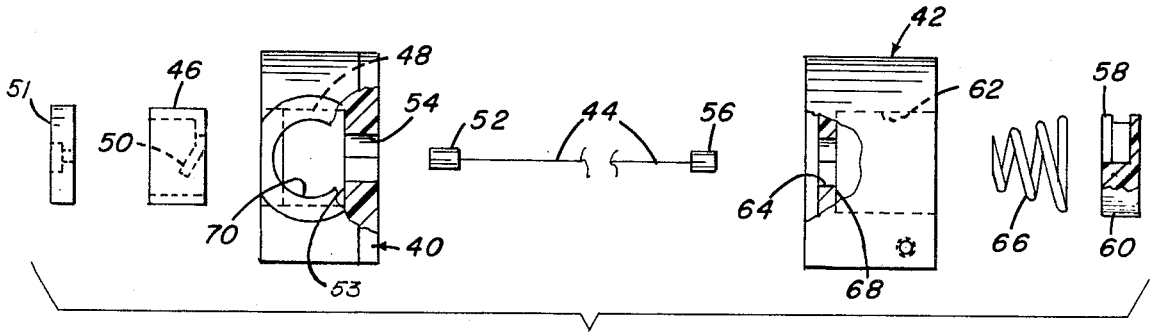
FIG. 3 is an exploded view partly in section of the corona wire and insulator blocks of the static discharge apparatus of FIG. 2 shown on an enlarged scale.
Figure 4:
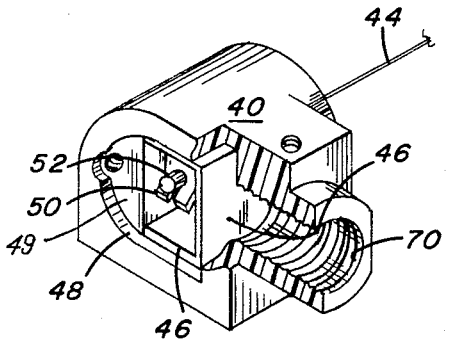
FIGS. 4 and 5 are perspective views, also on an enlarged scale, of the static discharge apparatus insulator end blocks, portions of the figures being broken away to facilitate viewing.

Insulator end blocks 40 and 42, formed of nonconductive material, are secured to respective ends of the shell 32. A single corona wire 44, connected between the end blocks 40 and 42, is located longitudinally of the shell 32 along the central axis of the shell. A high voltage contact 46, formed of conductive material, is positioned within a complimentary shaped bore 48 in the end block 40 (see exploded view of FIG. 3 or FIG. 4). A spacer 49 is inserted in the bore 48 to maintain the spatial position of the contact 46 within the bore and an end cap 51 seals the bore 48 when the apparatus 30 is assembled. The high voltage contact 46 has a downturned slotted portion 50 which captures a ferrule 52 crimped to one end of the corona wire 44 to electrically couple the high voltage contact to the corona wire. The interior end wall 53 of the block 40 has a diamond-shaped opening 54 located so that, in cooperation within the position of the ferrule 52 in the slotted portion 50 of the contact 46, the corona wire 44 may be positioned within the apex of one V of the diamond. Location of the corona wire in the V of the opening 54 spatially positions the wire within the shell 32 and the grid 34. The spatial position of the wire 44 is necessary to provide a balanced ion cloud.

Figure 5:
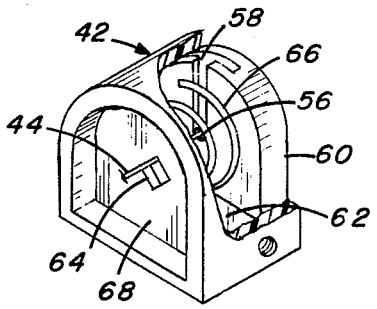

A second ferrule 56 is crimped to the opposite end of the corona wire 44. Upon assembly of the static discharge apparatus 30, the ferrule 56 is located in a T-slot 58 formed in an end cap 60. End cap 60 is slidably fitted within a complimentary shaped bore 62 of the end block 42 (see exploded view of FIG. 3 or FIG. 5). The wire 44 passes through a diamond shaped opening 64 located in the interior end wall 68 of the block 42, the opening 64 being substantially aligned with the opening 54. The location of the opening 64 is selected so that in cooperation with position of the ferrule 56 in the T-slot 58, the corona wire 44 may be positioned within an apex of one V of the diamond opening 64 (corresponding to the apex of opening 54), in the same manner as described above with respect to end block 40. Resilient means such as a conical coil spring 66, is positioned within the bore 62 between the wall 68 of the end block 42 and the end cap 60 (about the wire 44) to urge the cap to a position to provide tension in the corona wire 44. The tension in the corona wire 44 maintains the wire within the respective apexes of the corresponding V's of the openings 54 and 64 to insure accurate spatial positioning of the wire within the shell 32 and the grid 34 to assure a properly balanced ion cloud.

In order to permit an electrical coupling to be made between a high voltage source (not shown) and the corona wire 44, a threaded transverse bore 70 is formed in the end block 40. The threaded bore 70 receives a complimentary threaded male high voltage conductor 71 (FIG. 2) which is screwed into the bore until electrical contact is made with the high voltage contact 46. As is readily apparent, the bore 70 may have any preselected orientation with respect to the end block 40 dependent only upon the space requirements within the frame 14 of the feeder apparatus 10 and the location of the high voltage input. In this manner, the high voltage electrical coupling can be physically made directly with the contact 46, irrespective of the coupling between the electrical contact 46 and the corona wire 44. This provides for a minimum number of electrical interfaces in order to establish the high voltage coupling to the corona wire 44.

The static discharge apparatus 30 functions in the following manner. When a high voltage AC source (connected to the corona wire 44 through the conductor 71 and contact 46) is energized, the corona wire will generate an ion cloud of alternating polarity within the shell 32. With the wire maintained in spatial relationship to the shell 32 and the grid 34 by the end blocks 40 and 42, the ion cloud achieves a balanced steady state condition within the shell and grid. Further, since the shell 32 and grid 34 are grounded (through brackets 36, 38 and wireform 24), the steady state ion cloud is retained within the shell even though the grid has considerable open space. However, when a page bearing a triboelectrically generated static charge (or any other generated charge) is transported past the static discharge apparatus 30, the grid 34 will be subjected to a charge imbalance dependent upon the polarity of the charge on the page. Ions of the opposite polarity to that of the charge on the page will be free to pass through the grid 34, thus neutralizing the charge on the page. Accordingly, when the page returns to the hopper 16, it is substantially free of static charge. This neutralization of the static charge will improve the reliability of the page transporting functions within the recirculating feeder 10 by eliminating the potential of the page to adhere to or be repelled by surfaces (or other pages) with which it comes near.

From the foregoing it is apparent that this invention provides a grounded grid static discharge apparatus for effectively eliminating static charges on moving sheets. A corona wire is supported and spatially positioned within a shell of the apparatus by insulative end blocks. The shell has a grounded open-spaced grid located between the corona wire and the path of the moving sheets. A high voltage contact housed within one of the end blocks captures one end of the corona wire, and is electrically coupled to a high voltage source by a male connector threadably inserted into the block into engagement with the contact. Because the coupling is physically made directly to the high voltage contact, the male connector and the end block may assume any preselected orientation independent of the connection between the contact and the corona wire. Such arrangement minimizes the number of electrical interfaces necessary to establish the high voltage coupling to the corona wire. The end of the corona wire opposite the high voltage contact is supported in the opposite end block and is urged in a direction to place the wire in tension. The tension in the wire positions the wire in the respective apexes of aligned V-shaped openings in the end blocks to maintain the spatial position of the wire relative to the shell and grid.

The invention has been described in detail with particular reference to a preferred embodiment thereof, but it will be understood that variations and modifications can be effected within the spirit and scope of the invention.

We claim:

1. Static discharge apparatus adapted for use with a voltage source for eliminating static charge on a web moving along a travel path, said apparatus comprising;

a corona wire spaced from and extending transverse to said travel path, said corona wire producing a charged ion cloud when coupled to a voltage source;

grounded grid means, positioned between said corona wire and said travel path, for attracting the ions in said charged ion cloud and defining openings through which said ions pass when attracted by the static charges on such web as the web moves along said travel path adjacent to said grounded grid means; and means for accurately positioning said corona wire relative to said grounded grid means and electrically coupling such voltage source to said corona wire with a minimum of electrical interfaces, said positioning and coupling means comprising a contact member electrically coupled to and physically supporting one end of said corona wire, means adapted to be engaged by said corona wire for spacing said corona wire a predetermined distance from said grounded grid means, tension means coupled to the end of said corona wire opposed to said one end for maintaining said corona wire in engagement with said spacing means, and means for establishing an electrically conductive path to said contact member for such voltage source which path is physically spaced from the coupling between said corona wire and said contact member.

2. The invention of claim 1 wherein said spacing means comprises a first nonconductive support located adjacent to said contact member and a second nonconductive support located adjacent to said tension means.

3. The invention of claim 1 wherein said spacing means comprises a first housing formed of nonconductive material, mounted in fixed relation to said grounded grid means and defining a bore for receiving said contact member, said first housing having a wall defining an opening for receiving said corona wire to locate said one end of said corona wire relative to said grounded grid means, and a second housing formed of nonconductive material mounted in fixed relation to said grounded grid means and spaced from said first housing, said second housing having a wall defining an opening for locating said opposed end of said corona wire relative to said grounded grid means.

4. The invention of claim 3 wherein said opening defined by the wall of said first housing and said opening defined by the wall of said second housing are diamond shaped and in alignment, and wherein said corona wire is supported in corresponding apexes of said diamond shaped openings.

5. The invention of claim 3 wherein said tension means comprises an end cap slidably mounted in said second housing on the opposite side of said second housing wall from said first housing, means for capturing said opposed end of said corona wire in said end cap, and resilient urging means positioned between said end cap and said second housing wall for urging said end cap away from said wall.

6. The invention of claim 3 wherein said first housing further defines a threaded bore communicating with said contact member, and said connector is threaded into said bore to make electrical contact with said contact member.

7. Static discharge apparatus for eliminating static charge on sheets transported along a travel path, said apparatus comprising:

a corona wire spaced from and extending transverse to said sheet travel path, said corona wire producing a charged ion cloud when coupled to a high voltage source;

grounded grid means positioned between said corona wire and said sheet travel path for attracting the charged ion cloud of said corona wire, and permitting the passage of certain ions of said cloud when a sheet bearing a static charge is transported along said travel path adjacent to said grid means;

a shell connected to said grid means to form a chamber surrounding said corona wire; and first and second end blocks mounted in fixed relation to said shell for supporting said corona wire within said chamber, wherein said first end block comprises a first insulator housing, a high voltage contact secured within said first housing, means integral with said high voltage contact for capturing one end of said corona wire to electrically couple said high voltage contact to said corona wire, means for enabling a high voltage source to be directly connected to said high voltage contact irrespective of the coupling between said high voltage contact and said corona wire, and said first housing having a wall defining an opening for establishing a surface for positioning one portion of said corona wire in spaced relation to said grid means and said shell; and wherein said second end block comprises a second insulator housing, an end cap slidably supported in said second housing, said end cap coupled to the opposite end of said corona wire, said second housing having a wall defining a opening for establishing a surface for positioning the remaining portion of said corona wire in spaced relation to said grid means and said shell, and resilient means for urging said end cap in a direction to provide tension in said corona wire.

8. The invention of claim 7 wherein said grounded grid means comprises an open-spaced member formed of conductive material electrically coupled to ground.

9. The invention of claim 7 wherein said opening defined by the wall of said first end block and said opening defined by the wall of said second end block are diamond shaped and in alignment, and wherein said corona wire is supported in corresponding apexes of said diamond shaped openings.

10. The invention of claim 9 wherein said resilient urging means is a conical spring surrounding said corona wire, said conical spring being located between said end cap and said wall of said housing of said second end block in which said opening is defined.

11. The invention of claim 7 wherein said enabling means includes a threaded bore defined by said housing of said first end block communicating with said high voltage contact within said housing, whereby when a connector for a high voltage source is threaded into said bore, it is electrically coupled to said corona wire with a minimum number of electrical interfaces.

* * * * *